United States Patent [19]

Bell

[11] Patent Number: 4,908,970

[45] Date of Patent: Mar. 20, 1990

[54] GUN TRIGGER

[76] Inventor: Dennis L. Bell, 209 Main St., Atwood, Kans. 67730

[21] Appl. No.: 209,364

[22] Filed: Jun. 21, 1988

[51] Int. Cl.[4] ..... F41C 19/00

[52] U.S. Cl. ..... 42/69.02; 42/69.01

[58] Field of Search ..... 42/42.01, 65, 69.01, 42/69.02, 69.03, 70.05

[56] References Cited

U.S. PATENT DOCUMENTS 1,581,763 4/1926 Newton .
2,535,709 12/1950 Weeks .
3,726,040 4/1973 Cranston ..... 42/69.01
4,058,924 11/1977 Mullner ..... 42/69.01

FOREIGN PATENT DOCUMENTS 524187 11/1953 Belgium ..... 42/65
1904675 8/1970 Fed. Rep. of Germany ..... 42/65

*Primary Examiner*—Charles T. Jordan
*Assistant Examiner*—Richard W. Wendtland
*Attorney, Agent, or Firm*—Norvell E. Von Behren

[57] ABSTRACT

An improved gun trigger unit for a rifle or the like. The unit uses at least two spring biased moving members positioned one above the other. The members are pivotably mounted in relation to each other and pivot from a first engaged position to a second disengaged position. At least one of the members has rotatably mounted thereon a bearing in engagement with the other of the moving members. A movement of the trigger lever will pivot one of the members to activate the other of the members by the bearing rolling from a first engaged position to a second disengaged position thereby releasing the rifle bolt to fire the rifle.

15 Claims, 4 Drawing Sheets

GUN TRIGGER

BACKGROUND OF THE INVENTION

This invention relates generally to a gun trigger and more specifically to a new and novel gun trigger that operates on a new concept.

It is generally known in the trade that triggers may generally operate with a single lever or a series of levers which in turn control "sears." These "sears" may involve two or more metallic parts which drag across each other in the operation of the trigger. Because of resultant friction, wear on mating edges and dimensional changes in the respective parts, problems have been encountered in such prior art designs.

Other trigger systems have been designed and used in the past which contain complicated linkages and also use much involved safety systems to prevent accidental discharge of the firearm. These linkages are expensive to manufacture and require unnecessary assembly time to assemble the various parts into the completed trigger mechanism. In addition, the gun stocks generally require modification with such linkage triggers.

The construction of various prior art trigger units of the before mentioned type also results in further problems inherent in the particular design relating to the safety system on the trigger. For example, the linkage type trigger requires a right or left-hand safety lever which necessitates additional tooling to have the desired trigger unit.

The design problems in various prior art trigger systems also can cause latent safety problems. For example, many trigger and safety systems designed with that trigger use a safety which blocks the trigger lever itself. Should key parts in the trigger malfunction or break, and inadvertent discharge of the rifle may occur which could result in injury or death. In addition, many safety systems are designed so that the safety is placed in a firing mode to open the mechanism which creates the possibility for accidental discharge of the weapon.

While prior art triggers and safety systems have functioned to the apparent satisfaction of their designer and manufacturer, the problems before described have led to a new and unique design of a trigger and safety system which eliminates many of these problems and in addition provides many new desirable features which are expected in a quality trigger and safety system.

SUMMARY OF THE INVENTION

The applicant's new and novel trigger design comprises at least two spring biased moving members with one of the moving members being positioned above the other. The members are pivotably mounted in relation to each other and are spring biased and pivot from a first engaged position is a second disengaged position. At least one of the moving members has rotatably mounted thereon a bearing which engages with the other moving member in the operation of the trigger.

The rotatably mounted bearing is in juxtaposition to one of the members and rides in contact with the other member so that a movement of the trigger lever will pivot one of the members to activate the other of the members by the bearing rolling from a first engaged position to a second disengaged position to release the rifle bolt to fire the rifle.

As a result of this unique design, reduced friction deviation from conventional "sear" systems is accomplished. In other words, the sliding of two pieces of metal across each other is eliminated since the bearing rolls to a tangential threshold and disengages the sear on the rifle bolt.

Because of this unique design of minimal moving parts, a unique safety system is possible which includes many novel features hereinbefore impossible to obtain in prior art trigger systems. The unique safety system will be described hereinafter when referring to the Description of the Preferred Embodiment of the applicant's invention.

Accordingly it is an obJect and advantage of the subject invention to provide a unique trigger system which eliminates the dragging of two or more metallic parts across each other, thereby reducing friction, edge wear and dimensional changed in the mating parts.

Another object and advantage of the subject invention is to provide a new concept in triggers which eliminates complicated linkages which are also expensive to manufacture and to assemble into a finished product.

A further object and advantage of the subject invention is to provide a unique trigger unit which permits the standard types of safety systems to be discarded and which allows a new safety system to be used, thereby eliminating a low of safety problems encountered with prior art safety systems.

Still another object and advantage of the subject invention is to provide a new concept in triggers which reduces the travel of the trigger lever and which provides a fully adjustable trigger in at least five places as follows:

a. sear engagement;
trigger overtravel;
c. trigger creep;
trigger backlash; and
e. weight of trigger pull.

These and other objects and advantages of the subject invention will become apparent and will be more fully discussed hereinafter when referring to the following drawings and when reading the Description of the Preferred Embodiment which is given by way of illustration only.

DESCRIPTION OF THE PREFERRED EMBODIMENT

Figure 22:
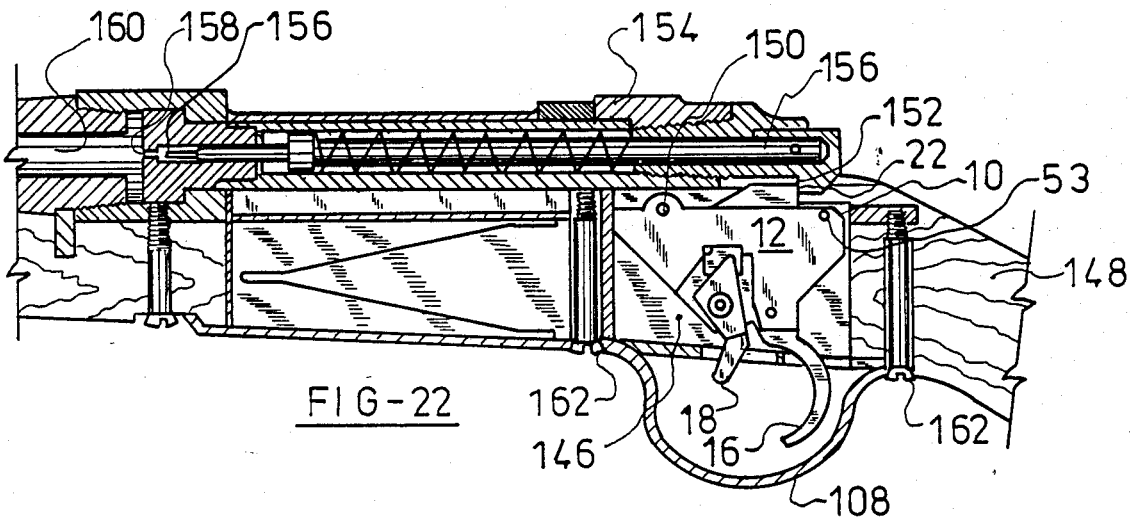
FIG. 22 is a left side cross-sectional view of the applicant's unique trigger assembly showing it mounted in a typical rifle stock and showing the Juxtaposition of the sear nose with the rifle bolt.

Referring now to the drawings in general and in particular to FIG. i of the drawings there is shown a left side elevational view of the applicant's unique trigger generally by the numeral 10 which comprises a hollowed out trigger housing 12 with a pin hole 14 for holding the trigger housing in an existing gunstock as shown in more detail in FIG. 22.

A downwardly extending trigger lever 16 is positioned behind a downwardly extending safety lever 18 and these levers are contained within the trigger guard as shown in FIG. 22. A sear 20 is exposed above the upper portion 19 of the housing 12 and has formed thereon a sear nose 22 which engages a mating surface on an existing rifle bolt as detailed more fully in FIG. 22.

FIGS. 2–5 show in more detail the completed trigger assembly 10 and will be referred to hereinafter when describing the novel safety assembly of the applicant's invention and the various adjustable features of the invention.

Figure 6:
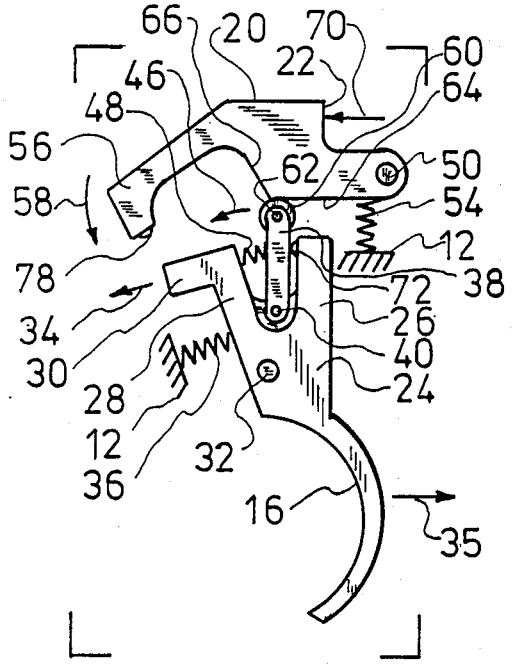
FIGS. 6 and 7 are schematic representations of the basic components in the subject trigger showing in FIG. 6 the engaged position and in FIG. 7 the disengaged position of the unique trigger mechanism.
Figure 7:
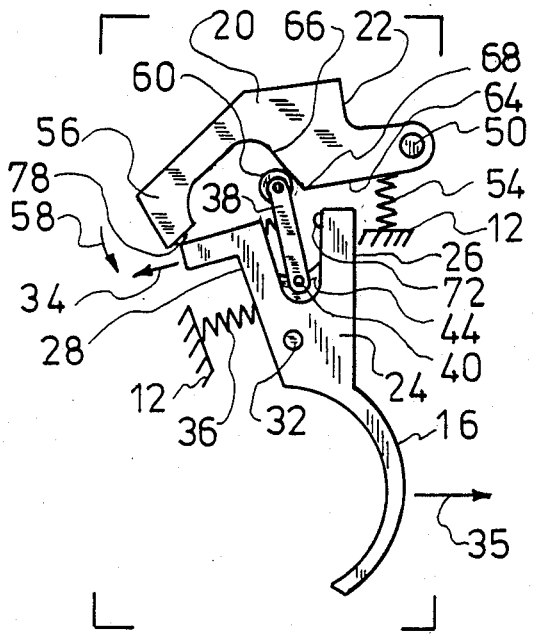

Referring now to FIGS. 6–7 there are shown schematic representations of the basic components in the trigger assembly. FIG. 6 is a left side elevational view of the basic components and shows these components in an engaged position with the rifle trigger lever 16 ready to be pulled or squeezed to discharge the rifle ammunition. FIG. 7 is the same left side elevational view of the basic components and shows the components in the disengaged position which would be the position of the parts after the trigger lever 16 has been squeezed and the rifle has discharged.

In FIGS. 6 and 7, the unique safety system has not been shown for purposes of clarity and the safety system will be described in full hereinafter especially when referring to FIGS. 16 and 17 of the invention.

In the preferred embodiment shown in FIGS. 6 and 7 of the drawings a trigger yoke 24 is formed with bifurcated arms 26 and 28. An extended trigger yoke finger 30 is formed on the bifurcated arm 28 and the trigger yoke 24 is pivotably mounted by the trigger yoke base pin 32 to the lower portion 31 as can be seen more clearly in FIGS. 1 and 2. The base pin 32 is positioned in a pair of holes 29 on the hollowed out trigger housing 12 and the yoke 24 pivots thereon during operation of the trigger.

The trigger yoke 24 pivots so that the extended trigger yoke finger 30 moves in the direction shown by the arrow 34 from an engaged position to a disengaged position whenever the integrally formed trigger lever 16 moves in the opposite direction, as shown by the arrow 35 as the trigger is squeezed. The trigger yoke 24 is spring biased by the spring 36 so that it returns to the engaged position shown in FIG. 6 after the trigger lever 16 is squeezed. The spring is positioned in the trigger housing 12 and in the trigger yoke which will be described more fully hereinafter.

Figure 9:
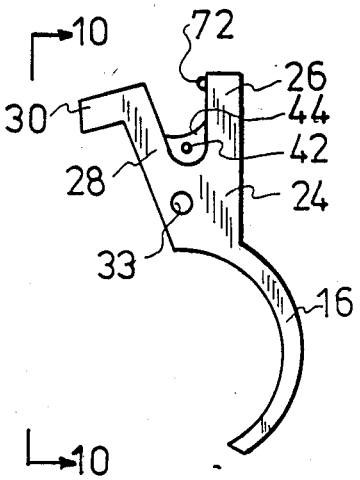
FIG. 9 is a left side elevational view of the trigger yoke used in the basic device.

A trigger toggle 38 is pivotably mounted by a trigger toggle pin 40 in a hole 42 formed in the yoke apex 44 as can be seen more clearly in FIG. 9. The trigger toggle 38 is thereby designed to move in the direction shown by the arrow 46 from the engaged position of FIG. 6 to the disengaged position of FIG. 7. The trigger toggle 38 is also spring biased by the spring 48 to return to the engaged position after the trigger lever 16 has been squeezed.

Figure 1:
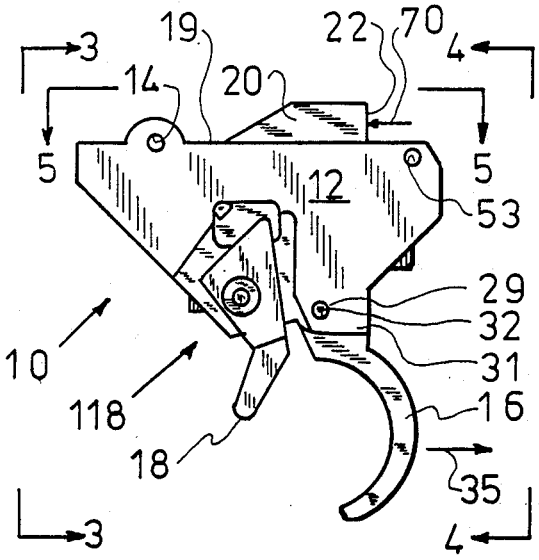
FIG. 1 is a left side elevational view of the subject unique trigger unit of the preferred embodiment.
Figure 2:
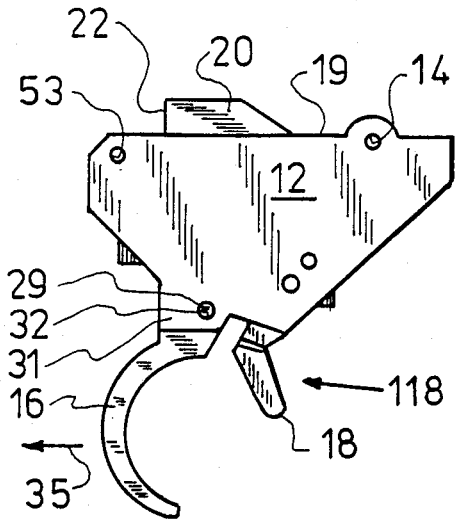
FIG. 2 is a right side elevational view of the trigger unit of FIG. 1.
Figure 5:
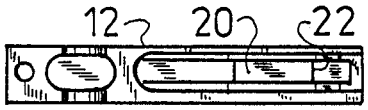
FIG. 5 is a top plan view, taken along line 5—5 of FIG. 1.

The trigger toggle 38 is engaged with the sear 20 which is also pivotably mounted on a base pin 50 positioned through a hole 52 in the sear 20 and through a pair of holes 53 in the trigger housing 12 as can be more clearly seen in FIGS. 1 and 2. A spring bias 54 returns the sear 20 to Its activated position of FIG. 6 so that the extended finger 56, formed at the sear 20, can move in the direction shown by the arrow 58 downwardly to the disengaged position and then back to the engaged position as a result of the action of the sear spring bias 54.

Figure 11:
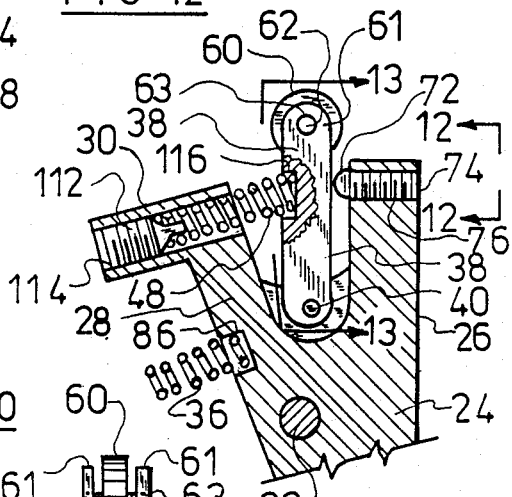
FIG. 11 is a partial cross-sectional view, taken along line 11—11 of FIG. 10 showing in detail some of the spring biases and adjustment features of the subject trigger.
Figure 13:
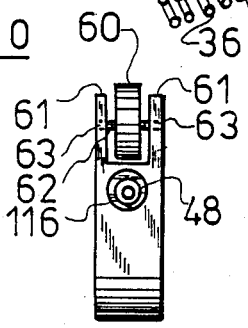
FIG. 13 is a front elevational view, taken along line 13—13 of FIG. 11 showing in detail the trigger toggle having rotatably mounted thereon the rotatable sear bearing.

The engagement of the sear 20 with the trigger toggle 38 is accomplished by the sear bearing 60 which is rotatably mounted by a bearing base pin 62 through a pair of holes 63 as can be seen more clearly in FIGS. 11 and 13 of the drawing. The sear bearing 60 is positioned between a pair of spaced apart arms 61 formed on the upper end of the trigger toggle 38.

The sear 20 has formed thereon a generally horizontal underside bearing surface 64 and a generally vertical underside bearing surface 66 which join at a point 68. The sear bearing 60 is positioned generally at the joining point 68 as can be seen in FIG. 6 in the engaged position and rides between the two juxtaposed surfaces as the trigger is squeezed as shown in FIG. 7.

There will now be described how the trigger yoke 24 moves in the direction shown by the arrow 34 whenever the trigger lever 16 moves in the direction shown by the arrow 35 to cause the sear 20 to be disengaged. The rifle bolt engages the sear nose 22 and applies a force shown by the arrow 70 when the bolt is cocked. This force 70 tends to cause a rotational moment around the sear base pin 50. However, the trigger toggle 38 with its rotatable sear bearing 60 stops the downward motion, shown by the arrow 58 of the sear 20 since the sear bearing 60 is in contact with the generally horizontal underside surface 64. In other words the rifle will not discharge whenever the parts are in the position shown in FIG. 6 which is the engaged position of the trigger.

Whenever the rifle user squeezes the trigger lever 16 in the direction shown by the arrow 35, the trigger yoke will engage the toggle 38 at the trigger fine adjustment screw 72 which is positioned in a drilled and tapped hole 74 formed in the bifurcated arm 26. When this occurs, the trigger toggle 38 will move in the direction shown by the arrow 46 and the rotatably attached sear bearing 60 will roll off of the generally horizontal underside surface 64 and will roll onto the generally vertical underside surface 66. This is the position shown in FIG. 7 and when this occurs, the extended sear finger 56 will move downwardly in the direction shown by the arrow 58 until the sear safety adjustment screw 76 strikes the extended sear finger 56 at the point 78 as shown in FIG. 7.

The sear safety adjustment screw 76 is positioned in a drilled and tapped hole 80 formed in the extended sear finger 56 as can be seen more clearly in FIG. 8 to be described hereinafter. After disengagement of the trigger as shown in FIG. 7, the trigger yoke return spring 36 which is positioned in a drilled and tapped hole 82 formed in the trigger housing 12 will return the trigger yoke 24 to the engaged position shown in FIG. 6. The trigger yoke return spring 36 is positioned on one end thereof on a trigger yoke return spring screw 84 and in a hole 86 in the bifurcated arm 28 of the trigger yoke 24 as can be more clearly seen in FIGS. 8 and 11 of the drawings.

Figure 3:
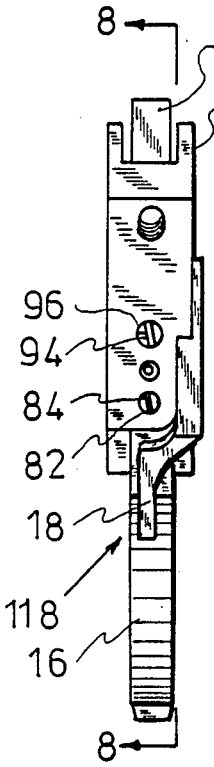
FIG. 3 is a front elevational view, taken along line 3—3 of FIG. 1.
Figure 4:
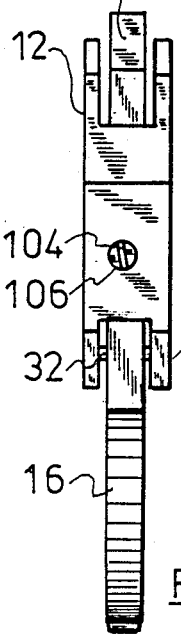
FIG. 4 is a rear elevational view, taken along line 4—4 of FIG. 1.
Figure 8:
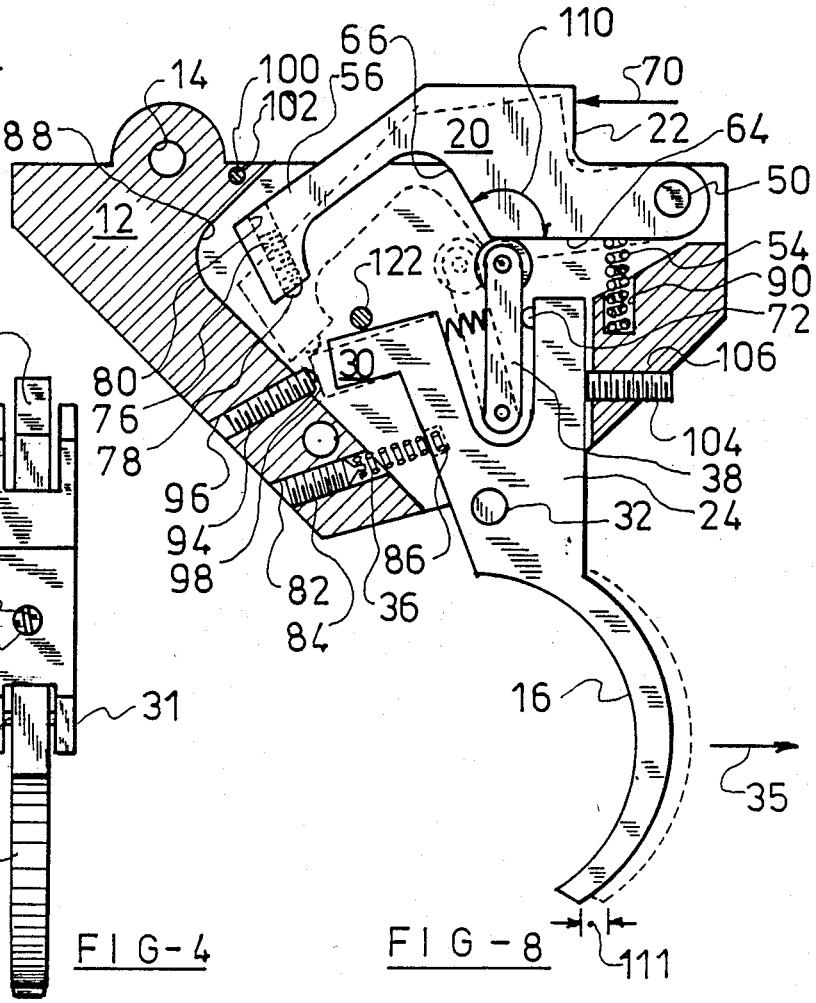
FIG. 8 is a left side cross-sectional view, taken along line 8—8 of FIG. 3 showing the basic components positioned in the trigger housing and showing these components solid in the engaged position and by dashed lines in the disengaged position. For purposes of clarity, the unique safety system of the subject invention has not been detailed in FIGS. 6–8.

Referring now to FIG. 8 of the drawings there is shown a left side cross-sectional view, taken along line 8—8 of FIG. 3 showing how the basic components of FIGS. 6 and 7 are positioned in the trigger housing 12. The basic components are shown in FIG. 8 in solid where engaged and in dashed lines where disengaged to correspond to FIGS. 6 and 7 respectively. A housing cavity 88 is formed in the housing 12 by means known in the art and receives the basic components of the yoke 24, the trigger toggle 38 and the sear 20 of the preferred embodiment. The sear return spring 54 is positioned at one end thereof in a hole 90 formed in the housing 12 and at the other end thereof in a hole 92 formed in the sear 20 as can be seen better in FIG. 15 of the drawings.

An overtravel adjustment screw 94 is positioned in a drilled and tapped hole 96 and engages the extended trigger yoke finger 30 at point 98. This adjustment screw 94 then adjusts the amount of travel that the trigger yoke 24 can move in the disengaged position of FIG. 7 of the drawings. A sear body stop pin 100 is positioned in a drilled hole 102 in the housing 12 and restricts the sear 20 from pivoting upward and popping out of the housing cavity 88 upon return to the engaged position as a result of the sear return spring 54.

A trigger yoke adJustment screw 104 is positioned in a drilled and tapped hole 106 and adjusts the position of the trigger lever 16 in the trigger guard 108 which is shown more clearly in FIG. 22 of the drawings. The preferred angle 110 between the surfaces 64 and 66 is 120° in the embodiment shown and may be more or less as desired within the spirit and scope of the invention. In the applicant's basic design, it can be seen in FIG. 8 how a slight motion of only 2000 of an inch in the trigger lever travel, shown by the arrow 111, can result in the sear bearing 60 rolling off of the underside surface 64 and onto the underside surface 66 of the sear 20 because of the mechanical dimensions of the basic components. This results in a truly fine "hair trigger" that can easily be adJusted by the previously discussed adjustment screws.

Figure 10:
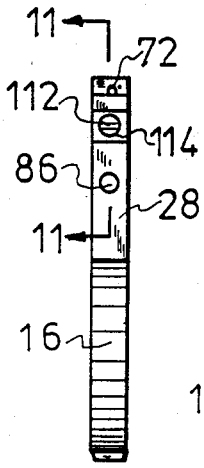
FIG. 10 is a front elevational view, taken along line 10—10 of FIG. 9.

Turning now to FIGS. 9 and 10 there will be seen in more detail the construction of the trigger yoke 24. A trigger toggle tension spring screw 112 is positioned in a drilled and tapped hole 114 and engages the toggle spring 48 to adjust the vertical position of the toggle 38 as can also be more clearly seen in FIG. 11. The toggle spring 48 is positioned in a hole 116 in the trigger toggle 38 to bias the toggle to return it to the engaged position. of FIG. 6 after the rifle has been fired and subsequently the rifle bolt has been cocked.

Figure 12:
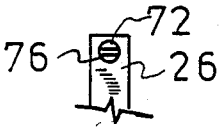
FIG. 12 is a rear elevational view, taken along line 12—12 of FIG. 11.
Figure 14:
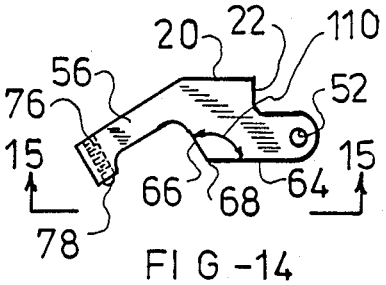
FIG. 14 is a left side elevational view of the sear used in the basic components of the invention.
Figure 15:
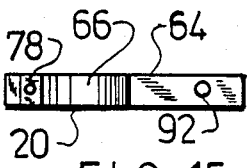
FIG. 15 is a bottom pawn view, taken along line 15—15 of FIG. 14.

FIGS. 11–13 show in more detail the various adjustments possible with the applicant's basic device as has been previously discussed while FIGS. 14 and 15 show in more detail the construction of the sear 20.

From the foregoing discussion it can be seen how the applicant's unique trigger, using the ball bearIng construction at the heart of the trigger, results in a trigger which has reduced friction deviation over conventional sear systems where mating parts rub together as the juxtaposed pieces of metal slide across each other. By the use of the novel bearing feature, at least one of the mating parts rolls to a tangential threshold at the joining point 68 between the Joined underside surfaces 64 and 66. By rolling off of the tangential threshold at point 68, the sear 20 is disengaged to fire the rifle.

With the use of this unique construction, the trigger lever has reduced travel which is a desirable feature in quality triggers. In addition the unique trigger is fully adjustable for sear engagement, overtravel, creep, backlash and for the weight of trigger pull. The applicant's unique trigger components are also interchangeable to provide an economical "family" of trigger model adaptations in various rifles such as the Ruger, Remington, Interarms and others.

Referring now to FIGS. 16–21 there will be described the applicant's unique trigger safety design which is possible with the novel trigger hereinbefore described. While it is believed that the applicant's trigger safety incorporates many features unobtainable with present safety systems, the applicant's basic trigger may be used with other safety systems presently designed within the spirit and scope of the invention.

Figure 16:
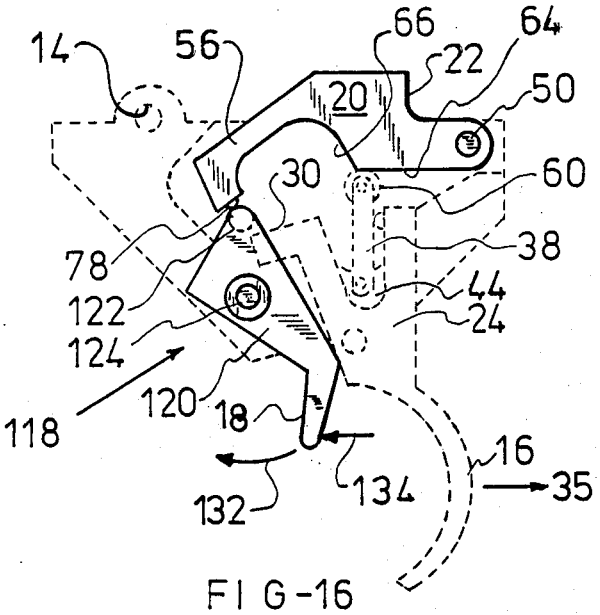
FIGS. 16 and 17 are schematic representations of the novel safety system designed for use with the applicant's unique trigger unit with FIG. 16 showing the safety engaged and with FIG. 17 showing the safety disengaged.
Figure 17:
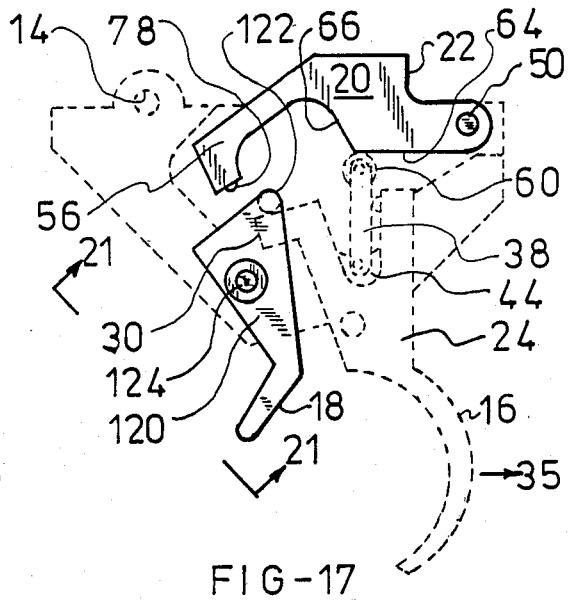

FIGS. 16 and 17 are schematic representations of the novel safety system with FIG. 16 showing the safety engaged and with FIG. 17 showing the safety disengaged. In FIGS. 16 and 17 the main components relating to the safety are shown in solid lines while the rest of the trigger mechanism is shown in dashed lines. FIGS. 16 and 17 are also left side cross-sectional views, taken along line 8—8 of FIG. 3 and are similar to the FIG. 8 view except the safety is featured in FIGS. 16 and 17.

The novel safety is shown in FIG. 16' generally by the numeral 118 and comprises a central section 120 having a safety lever 18 formed on the lower portion thereof and a sear engagement nose 122 formed on the upper portion thereof. The safety 118 is pivotably mounted on a base screw 124 which is positioned in a countersunk seat 126 and in a hole 128 in the central section 120 through which the base screw passes. The base screw 124 is fixed into a drilled and tapped hole 130 in the housing 12 which is shown in the drawings more clearly in FIG. 21.

The safety lever 18 is designed to pivot in the direction shown by the arrow 132 whenever the user of the rifle pushes on the safety lever 18 in the direction of the arrow 134. When the safety is engaged as shown in FIG. 16, the sear engagement nose 122 is positioned between the sear safety adjustment screw 76 in the extended sear finger 56 and between the extended trigger yoke finger 30 of the trigger yoke 24. When in the engaged position of FIG. 16, the trigger toggle 38 with its sear bearing 60 is prevented from riding off of the underside surface 64 to the underside surface 66.

In order to disengage the trigger safety 118, the safety lever 18 is pushed in the direction shown by the arrow 134 to pivot the safety 118 in the direction shown by the arrow 132 to the position shown in FIG. 17 of the drawings. This moves the sear engagement nose 122 out from between the sear safety adjustment screw 76 and the extended trigger yoke finger 30. Thereafter the sear 20 is free to move downwardly whenever the trigger 16 is squeezed. The position of the sear engagement nose 122 in the disengaged position can be seen more clearly in FIG. 8 of the drawings.

Figure 18:
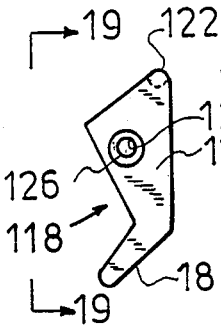
FIG. 18 is a left side elevational view of the safety.
Figure 19:
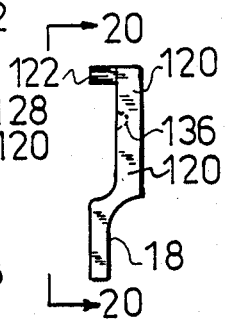
FIG. 19 is a front elevational view, taken along line 19—19 of FIG. 18.
Figure 20:
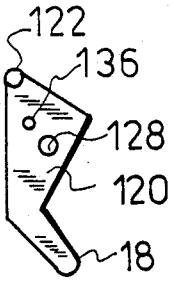
FIG. 20 is a right side elevational view, taken along line 20—20 of FIG. 19.
Figure 21:
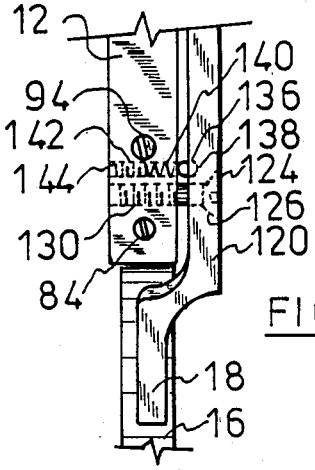
FIG. 21 is a front elevational view, taken along line 21—21 of FIG. 17 showing in greater detail the safety detente.

FIGS. 18–20 show more detail of the safety 118 and show in FIG. 19 to 21 the safety detent 136 which is used to insure that the safety is positively engaged until disengaged and may not be accidentally disengaged. A detent ball 138 is positioned partly in the detent 136 in the central section 120 of the safety 118 and partly in a hole 142 formed in the housing 12 being held therein by a detent spring 140. The tension adjustment on the detent spring 140 is controlled by a detent tension screw 144.

By referring back to FIG. 3, there can be seen one of the novel features of the applicant's safety 118. Because of the particular configuration of the safety 118, the safety lever 18 lies directly in front of the trigger lever 16. This positioning eliminates the need for right or left-hand safety options on the rifle which also eliminates unnecessary expensive tooling.

Another feature of the applicant's safety system is the positioning of the sear engagement nose 122 directly between the parts 56 and 30 of the sear 20 and the yoke 24 respectively. Since most trigger and safety systems block the trigger lever 16 itself, a breakage or malfunction of the key parts could cause an inadvertent discharge. The applicant's direct sear block concept circumvents most of these conditions.

A further feature of the applicant's novel safety is apparent when it is recognized that many safety systems require the safety to be placed in the firing mode to open the mechanism thereby creating the possibility for accidental discharge. The physical position of the applicant's safety lever 18 inside the trigger guard 108 helps prevent the inadvertent disengagement of the safety by helping shield the safety lever 18 from catching brush or other things while using the rifle for hunting.

The applicant's novel safety also permits the rifle bolt to be removed with the safety "on" or engaged on all rifles. The novel safety also eliminates special linkage parts such as from the tang area to the trigger body. In addition, the safety can be removed easily and the trigger will still function should a conventional safety be desired.

Turning now to FIG. 22 of the drawings there is shown a left side cross-sectional view of a rifle showing the applicant's trigger 10 positioned therein. The trigger housing 12 is positioned in a cavity 146 of the rifle stock 148 and is held therein by the pin 150 positioned in the holes 14 in the housing. The sear nose 22 engages the cocking piece sear notch 152 on the rifle bolt 154. When the rifle bolt 154 is cocked the cocking piece sear notch 152 exerts a force in the direction of the arrow 70 as shown in FIGS. 6 and 8 as hereinbefore described. The squeezing of the trigger lever 16 when the safety 18 is disengaged results in the firing pin 156 engaging the rifle ammunition at 158 in the chamber 160 to discharge the ammunition.

A pair of bolts 162 hold the trigger guard 108 in the position shown around the trigger 16 and the safety 18. From the foregoing it can be seen how the applicant's novel trigger and safety accomplish all the desired results before mentioned as well as providing for additional fine adjustments which effect the trigger lever travel. The novel use of a bearing at the heart of the trigger provides "take up" for wear on the threshold components without physical cutting, buildup or stoning of these parts, a feature heretofore unobtainable in prior art trigger mechanisms.

Figure 23:
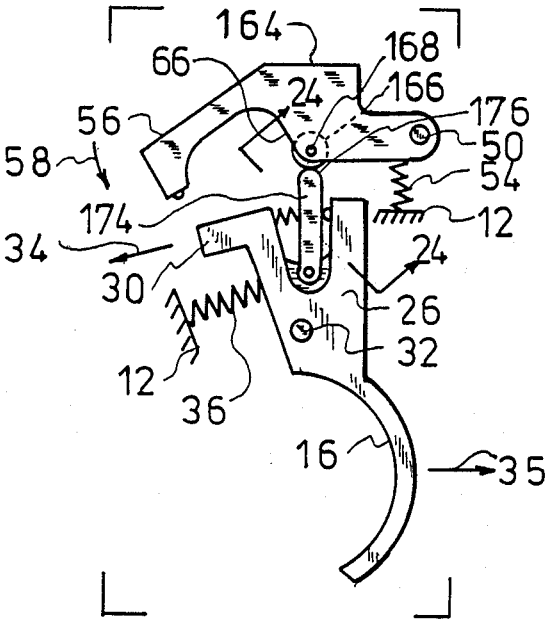
FIG. 23 is a left side elevational view, similar to FIG. 6, showing a modification of the basic components of the invention.
Figure 24:
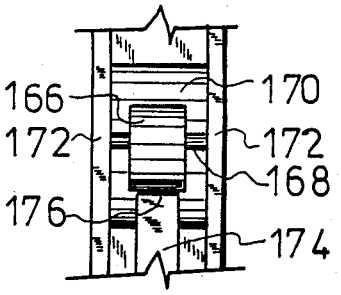
FIG. 24 is a front partial cross-sectional view, taken along line 24—24 of FIG. 23.

While a review of the foregoing shows and describes the preferred embodiment of the invention, the applicant is not to be limited to that embodiment which has been given by way of illustration only. FIGS. 23—26 show modifications to the applicant'3 s invention which, among other modifications possible, would be considered to be within the spirit and scope of the basic concept. FIG. 23 is a left side elevational view, similar to FIG. 6, showing a modification of the basic components wherein a modified sear 164 is constructed to contain a modified sear bearing 166 rotatably mounted by the pin 168 held in the cavity 170 by the opposite facing arms 172 shown more clearly in the cross-sectional view of FIG. 24. A modified toggle 174 would contain a bearing surface 176 which would ride on the bearing 166 as the device functions as before described when referring to the preferred embodiment.

Figure 25:
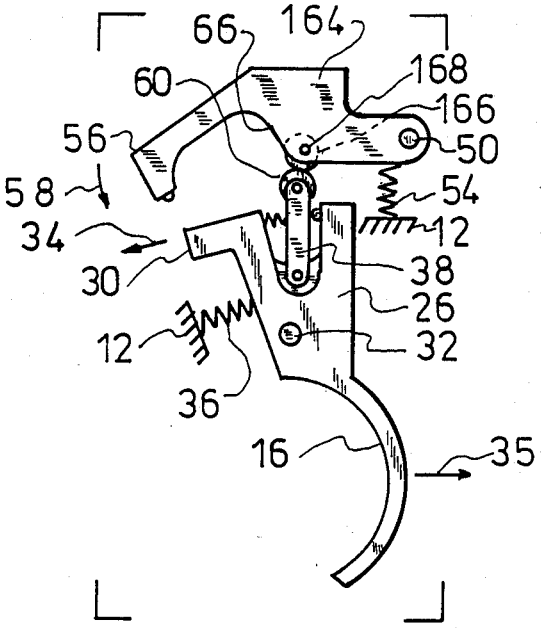
FIG. 25 is a left side elevational view, similar to FIG. 6 showing another modified form of the basic invention.

FIG. 25 is a left side elevational view, similar to FIG. 6, showing another modification of the basic components of the applicant's invention. Here a modified sear 164 as described and shown in FIGS. 23–24 would be used with the trigger toggle 38 and sear bearing 60 of the preferred embodiment to provide for two sear bearings 60 and 166 to be in rolling contact with each other as the trigger operates as before described.

Figure 26:
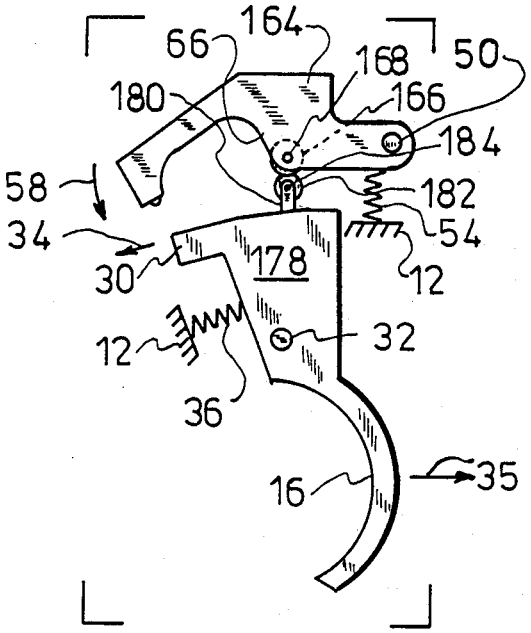
FIG. 26 is a left side elevational view, similar to FIG. 6, showing yet another modification of the basic invention.

FIG. 26 is a left side elevational view, similar to FIG. 6, showing yet another modification of the basic invention where a modified yoke 178 is formed without bifurcated fingers and with a modified shortened toggle 180 having a modified sear bearing 182 rotatably mounted on a pin 184 similar to the preferred embodiment. Also the modified sear 164 of FIGS. 23–24 could be used or other sear designs within the spirit and scope of the inventions.

While the modifications of FIGS. 23–26 show several variations it should be apparent that the novel designs have at least two spring biased moving members with one of the moving members being positioned above the other and with at least one of the members having rotatably mounted thereon a sear bearing for engagement with the other of the moving members. Other variations are thereby considered to be within the applicant's design scope and the preferred embodiment and its variations have been given herein by way of illustration only. The applicant is not to be limited therein since the preferred embodiment and variations are illustrative only and not limiting in any sense of the word.

Having described my invention, I claim:

1. In a rifle of the type having a trigger lever mounted below a rifle bolt and positioned in a gunstock, the trigger unit having a plurality of spring biased moving parts, the improvement comprising:

a. the trigger unit being positioned in a housing and having at least two spring biased moving members, at least two of the springs from the spring bias engaging the housing and the respective moving member;

(1) one of the moving members being positioned above the other of the moving members, the members being pivotably mounted in relation to each other and being spring biased from the housing to pivot from a first engaged position to a second disengaged position;

(2) at least one of the moving members having rotatably mounted thereon a bearing for engagement with the other of the moving members; and b. the rotatably mounted bearing being in juxtaposition to one of the members and riding in contact with the other of the members so that a movement of the trigger lever will pivot one of the members to activate the other of the members by the bearing rolling from a first engaged position to a second disengaged position thereby releasing the rifle bolt to fire the rifle.

2. The improvement as defined in claim 1 further comprising the trigger unit having at least three spring biased moving members, with at least two of the springs of the spring bias engaging the housing and at least one of the springs of the spring bias engaging one of the moving members.

3. The improvement as defined in claim 1 further comprising one of the moving members being a sear and the other of the moving members being a trigger yoke.

4. The improvement as defined in claim 3 wherein the bearing is rotatably mounted on the trigger yoke.

5. The improvement as defined in claim 1 wherein the trigger unit has pivotably mounted thereon a trigger safety lever for engagement between both of the moving members to prevent motion of the members by blocking movement of at least one of the members thereof, thereby preventing the firing of the rifle.

6. The improvement as defined in claim 5 wherein the trigger safety has formed thereon a sear engagement nose and the nose is positioned between the two spring biased moving members thereby preventing motion of the members.

7. In a rifle of the type having a trigger unit mounted below a rifle bolt and positioned in a gun stock, the trigger unit having a plurality of moving parts which are spring biased, the improvement comprising:

a. the trigger unit being positioned in a housing and having three spring biased moving members;

(1) the first moving member being a pivotably mounted trigger yoke having formed thereon a trigger lever and a pair of bifurcated arms;

(2) the second moving member being a pivotably mounted trigger toggle having a sear bearing rotatably mounted thereon, the trigger toggle being pivotably mounted on the trigger yoke;

(3) the third moving member being a sear, pivotably mounted to the housing and being positioned above the trigger yoke and trigger toggle with the sear bearing engaging the sear and riding on the sear between a first engaged position and a second disengaged position; and b. the rotating sear bearing riding on the sear between a first engaged position to the second disengaged position permitting a reduced trigger lever travel and minimizing trigger parts wear and tear.

8. The improvement as defined in claim 7 further comprising the sear having formed thereon a generally horizontal bearing surface on the underside of the sear and generally vertical surface joining the generally horizontal bearing surface at a point for engagement with the sear bearing when the trigger is squeezed.

9. The improvement as defined in claim 7 further comprising;

c. a trigger safety being mounted on the housing to prevent the trigger lever from being moved.

10. The improvement as defined in claim 7 further comprising the trigger safety being pivotably mounted on the housing and having a sear engagement nose formed thereon for positioning between the trigger yoke and the sear to prevent motion thereof thereby preventing firing of the rifle.

11. A trigger unit for use in a rifle, having a gun stock or the like and designed to trigger a bolt having a cocking piece sear notch, the bolt serving to detonate explosive ammunition, comprising:

a. a generally hollow housing, for positioning and mounting in the gun stock below the bolt;

b. a trigger yoke, pivotably mounted in the hollow housing, the yoke having formed thereon;

(1) a trigger lever;

(2) a pair of bifurcated arms having an apex area, one of the arms having formed thereon an extended trigger yoke finger;

c. a trigger toggle having opposite ends and being pivotably mounted on one end thereof to the trigger yoke at the apex area, the trigger toggle having a sear bearing, rotatably mounted thereon on the other end thereof, the trigger toggle being positioned generally vertical with the sear bearing extending upwardly;

d. a sear, pivotably mounted in the hollow housing and above the trigger yoke, the sear having formed thereon;

(1) a sear nose for engagement with the cocking piece sear notch in the bolt;

(2) an extended sear finger for engagement with the trigger yoke finger whenever the trigger lever is squeezed;

(3) a generally horizontal bearing surface on the underside of the sear for engagement with the sear bearing when the trigger has not been squeezed;

(4) a generally vertical bearing surface joining the generally horizontal bearing surface at a point for engagement with the sear bearing when the trigger is squeezed, the sear bearing being positioned at the point joining the two bearing surfaces and riding between the two bearing surfaces as the trigger lever is squeezed, (5) a plurality of spring bias members positioned inside the housing and engaging the yoke, the toggle and the sear to return the yoke, toggle and sear to their engaged position; and (6) the movement of the trigger lever in one direction causing the bifurcated arms to move in an opposite direction, one of the arms striking the toggle and moving the toggle and the attached sear bearing in the same opposite direction, the sear bearing then rolling off of the generally horizontal bearing surface onto the joining generally vertical bearing surface which permits the sear to rotate downwardly thereby moving the sear nose out of engagement with the cocking piece sear notch to allow the bolt to detonate the explosive ammunition, the downward motion of the sear being stopped as the extended sear finger engages the extended trigger yoke finger.

12. The trigger unit as defined in claim 11 further comprising:

e. a trigger safety being mounted on the housing to prevent the trigger lever from being moved.

13. The trigger unit as defined in claim 12 further comprising the trigger safety being pivotably mounted on the housing and having a sear engagement nose formed thereon for engagement with the trigger yoke and the sear to prevent motion thereof thereby preventing firing of the rifle.

14. In a rifle of the type having a trigger lever mounted below a rifle bolt and positioned in a gunstock, the trigger unit having a plurality of spring biased moving parts, the improvement comprising:

a. the trigger unit being positioned in a housing and having at least two spring biased moving members, one of the moving members being a sear and the other of the moving members being a trigger yoke;

(1) one of the moving members being positioned above the other of the moving members, the members being pivotably mounted in relation to each other and being spring biased to pivot from a first engaged position to a second disengaged position;

(2) the trigger yoke having rotatably mounted thereon a bearing for engagement with the other of the moving members;

(3) the trigger yoke has mounted thereon a trigger toggle with the bearing being mounted on the trigger toggle and;

b. the rotatably mounted bearing being in juxtaposition to the sear and riding in contact with the sear so that a movement of the trigger lever will pivot the trigger yoke to activate the sear by the bearing rolling from a first engaged position to a second disengaged position thereby releasing the rifle bolt to fire the rifle.

15. In a rifle of the type having a trigger lever mounted below a rifle bolt and positioned in a gunstock, the trigger unit having a plurality of spring biased moving parts, the improvement comprising:

a. the trigger unit being positioned in a housing and having at least two spring biased moving members;

(1) one of the moving members being positioned above the other of the moving members, the members being pivotably mounted in relation to each other and being spring biased to pivot from a first engaged position to a second disengaged position;

(2) at least two of the moving members having rotatably mounted thereon a bearing for engagement with the other of the moving members; and b. the rotatably mounted bearings being in juxtaposition to each other and riding in contact with each other so that a movement of the trigger lever will pivot one of the members to activate the other of the members by one of the bearings rolling from a first engaged position to a second disengaged position thereby releasing the rifle bolt to fire the rifle.

* * * * *